United States Patent [19]

Kreider et al.

[11] 4,212,633

[45] Jul. 15, 1980

[54] VACUUM ELECTRIC FURNACE

[75] Inventors: Benjamin A. Kreider, Richboro; William J. Metalsky, Warminster, both of Pa.

[73] Assignee: Abar Corporation, Feasterville, Pa.

[21] Appl. No.: 961,298

[22] Filed: Nov. 16, 1978

[51] Int. Cl.[2] ..... F27B 9/14

[52] U.S. Cl. ..... 432/122; 432/123; 432/194; 432/234; 432/249; 13/31 R

[58] Field of Search ..... 432/122, 123, 126, 127, 432/194, 233, 234, 226, 249, 253, 243, 244; 13/31, 32; 198/600, 633, 774

[56] References Cited

U.S. PATENT DOCUMENTS

| | | | |
|---|---|---|---|
| 3,471,134 | 10/1969 | Cone | 432/243 |
| 3,664,649 | 5/1972 | Brockmann | 432/122 |
| 3,716,222 | 2/1973 | Anderson | 432/234 |
| 3,749,550 | 7/1973 | Suydam | 432/122 |
| 3,792,965 | 2/1974 | Bengtsson | 432/122 |
| 3,887,064 | 6/1975 | Brockmann | 432/122 |
| 4,102,637 | 7/1978 | Kreider et al. | 432/249 |
| 4,144,022 | 3/1979 | Fusco | 432/249 |

*Primary Examiner*—Henry C. Yuen

*Attorney, Agent, or Firm*—Zachary T. Wobensmith, 2nd; Zachary T. Wobensmith, III

[57] ABSTRACT

A vacuum electric furnace is disclosed for operation with a hostile environment therein which may be above the melting temperature of most metals, other than refractory metals, with apparatus in the furnace for advancing the work, the advancing apparatus being a walking beam with provisions for protecting the exposed portions of the walking beam by the use of graphite and with work supporting buttons of molybdenum to prevent the work from reacting with the graphite at high temperatures, and with separation and shielding of portions of the walking beam from the hot zone and with liquid cooling of the shielded portions.

13 Claims, 9 Drawing Figures

VACUUM ELECTRIC FURNACE

BACKGROUND OF THE INVENTION

1. Field of the Invention

This invention relates to vacuum electric furnaces and more particularly to apparatus for advancing the work pieces in the furnace.

2. Description of the Prior Art

Various provisions have heretofore been made for advancing work pieces within a vacuum electric furnace.

It has heretofore been proposed, for use in furnaces, to employ conveying apparatus of the walking beam type having the beams thereof exposed within the furnace made of refractory material and with provisions for cooling. The structures heretofore provided for that purpose were, however, unsuited for vacuum electric furnaces operating at temperatures in excess of 2200° F. and were not adequately resistant if such temperatures were employed and were subject to dimensional instability. An example of such walking beams is illustrated at pages 270 to 273, inclusive, of Industrial Furnaces, 4th Edition, Vol II, by W. Trinks and M. H. Mawhinney, published 1967, by John Wiley and Sons, Inc., New York, N.Y.

The work pieces may be in a hostile environment with temperatures at levels at which most metals, other than refractory metals, are unstable thereby rendering the work piece advancing structure dimensionally unstable.

SUMMARY OF THE INVENTION

In accordance with the invention, apparatus is provided for use in vacuum electric furnaces having a hostile environment for advancing work pieces in the furnace and more specifically a walking beam construction in which the exposed parts are of a material such as graphite or graphite with molybdenum buttons which withstand the hostile environment, have dimensional stability and which prevent interaction between the work piece and the graphite, the remaining parts of the walking beam within the furnace being shielded from the hot zones with liquid cooling of the primary supporting structure.

It is the principal object of the invention to provide conveying or advancing apparatus for use in a vacuum electric furnace having a hostile environment therein and which is resistant to the hostile environment with freedom from interaction between the work pieces and conveying apparatus.

It is a further object of the invention to provide, in apparatus of the character aforesaid, for protective features to avoid rapid disintegration of the conveying apparatus.

It is a further object of the invention to provide, in apparatus of the character aforesaid, high temperature resistant components exposed in the furnace, and for shielding and protecting less resistant portions of the apparatus.

It is a further object of the invention to provide, in apparatus of the character aforesaid, for simple but effective cooling of portions of the equipment which are not resistant to the high temperatures in the furnace.

It is a further object of the invention to provide, in apparatus of the character aforesaid, a controlled step by step advance of the work pieces so that their location within the furnace will be known.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
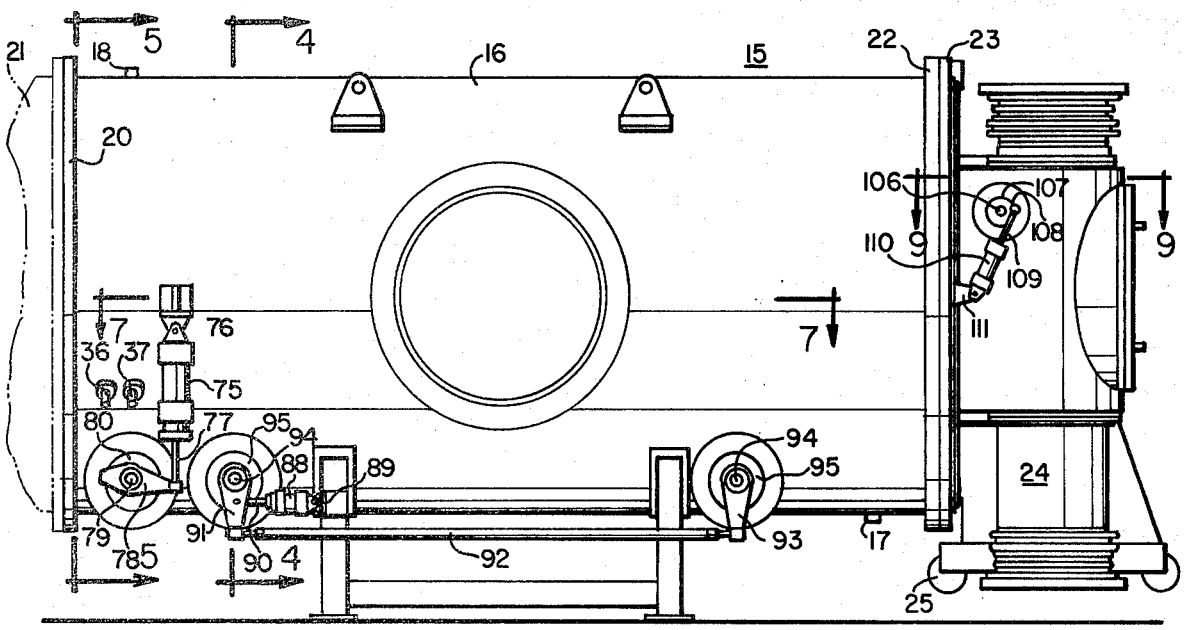
FIG. 1 is a view in side elevation of a furnace with advancing apparatus in accordance with the invention.
Figure 2:
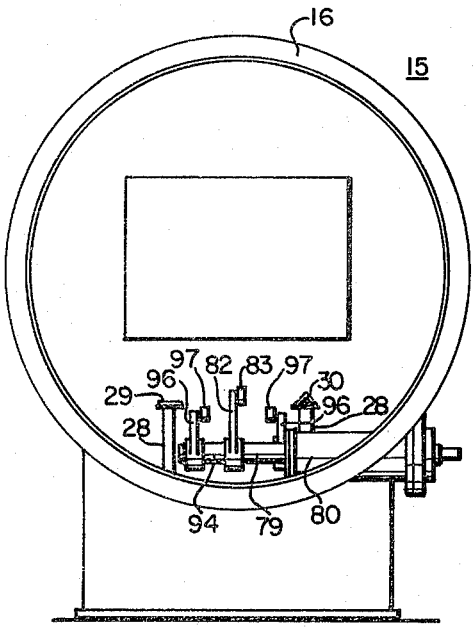
FIG. 2 is an end elevational view of the furnace of FIG. 1 as seen from the left.
Figure 3:
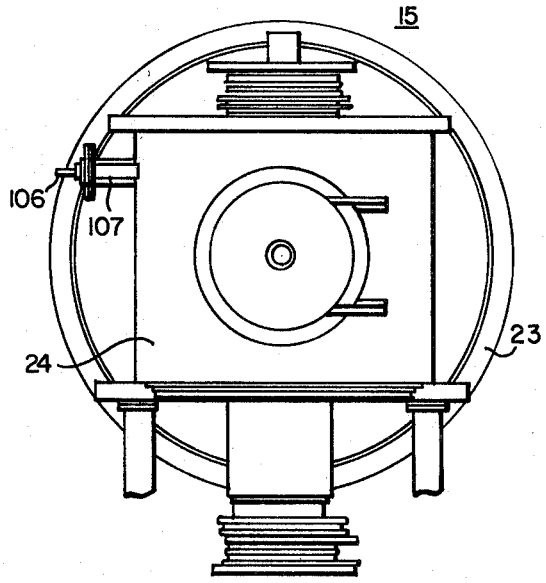
FIG. 3 is an end elevational view of the furnace of FIG. 1 as seen from the right.
Figure 4:
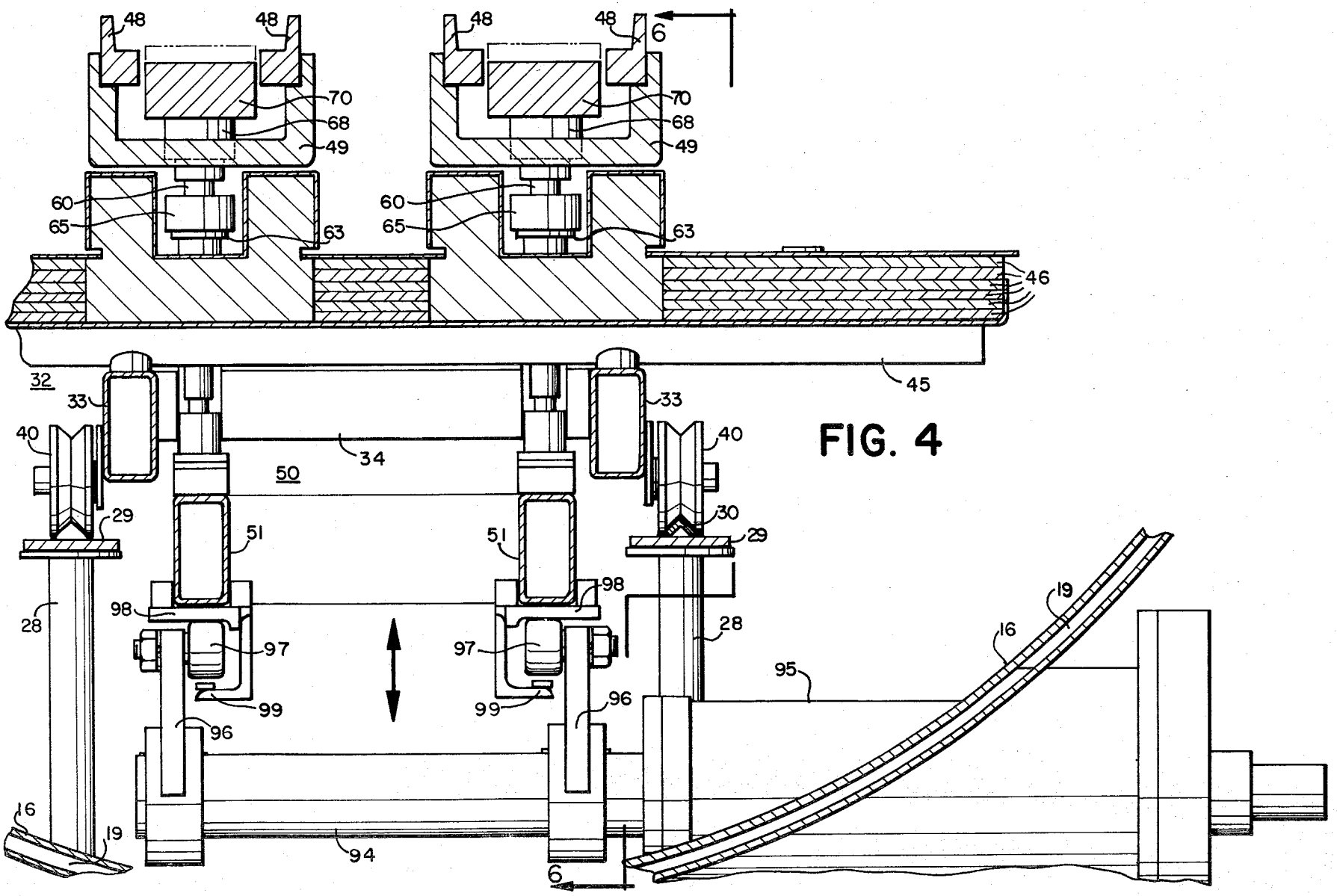
FIG. 4 is a fragmentary transverse vertical sectional view, enlarged, taken approximately on the line 4—4 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings a furnace 15 is shown having an outer water jacketed tank 16 with a cooling liquid inlet connection at 17 and a liquid discharge connection at 18, communicating with a cooling liquid circulating space 19.

The tank 16 has an end flange 20 for connection of suitable loading or charging mechanism 21 not shown in detail but which can be that shown in our companion application Ser. No. 955,601, filed Oct. 26, 1978.

The tank 16 has an end flange 22 for connection of a flange 23 of unloading mechanism 24 for the work pieces. The unloading mechanism 24 is preferably supported on wheels 25 for removal, upon disconnecting of the flange 23 from the flange 22 for access to the interior of the furnace 15 for inspection and maintainance.

Figure 8:
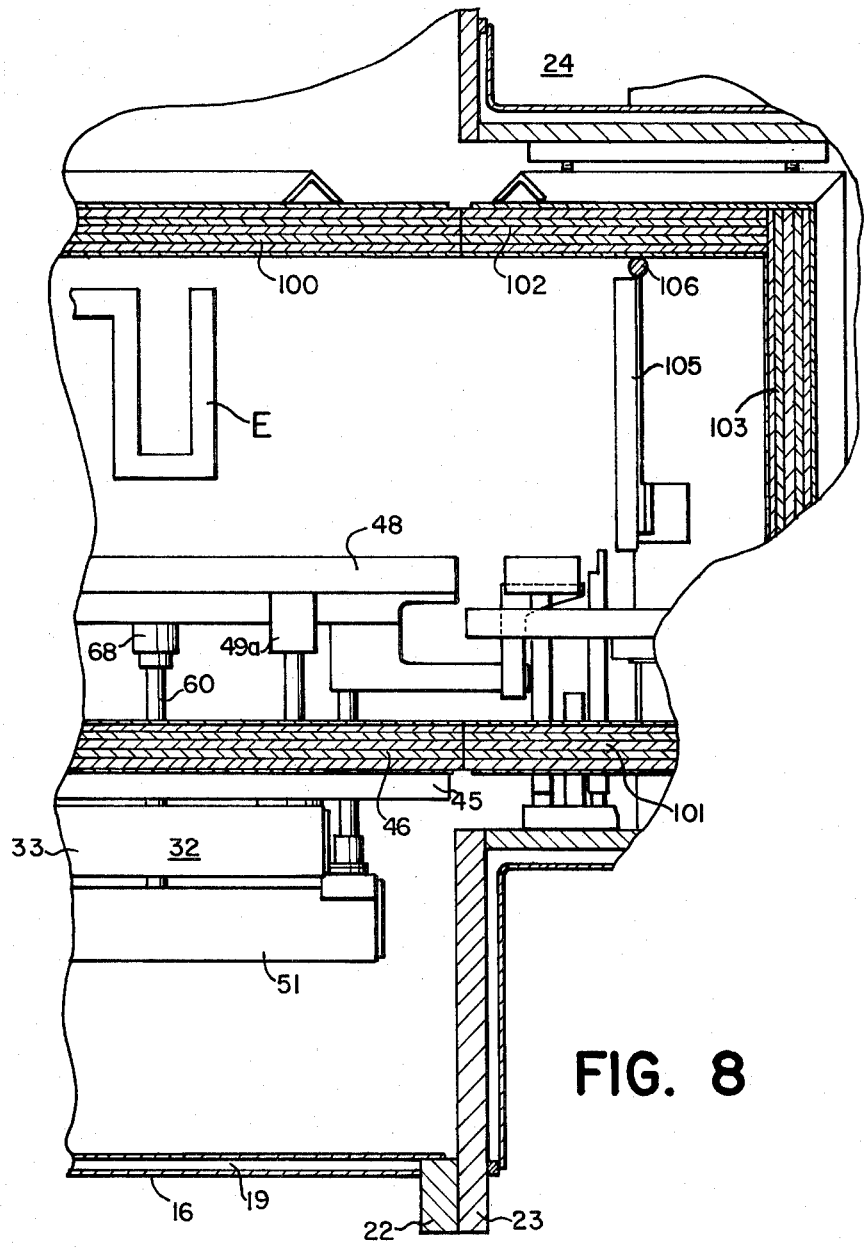
FIG. 8 is a fragmentary vertical sectional view taken approximately on the line 8—8 of FIG. 9.
Figure 9:
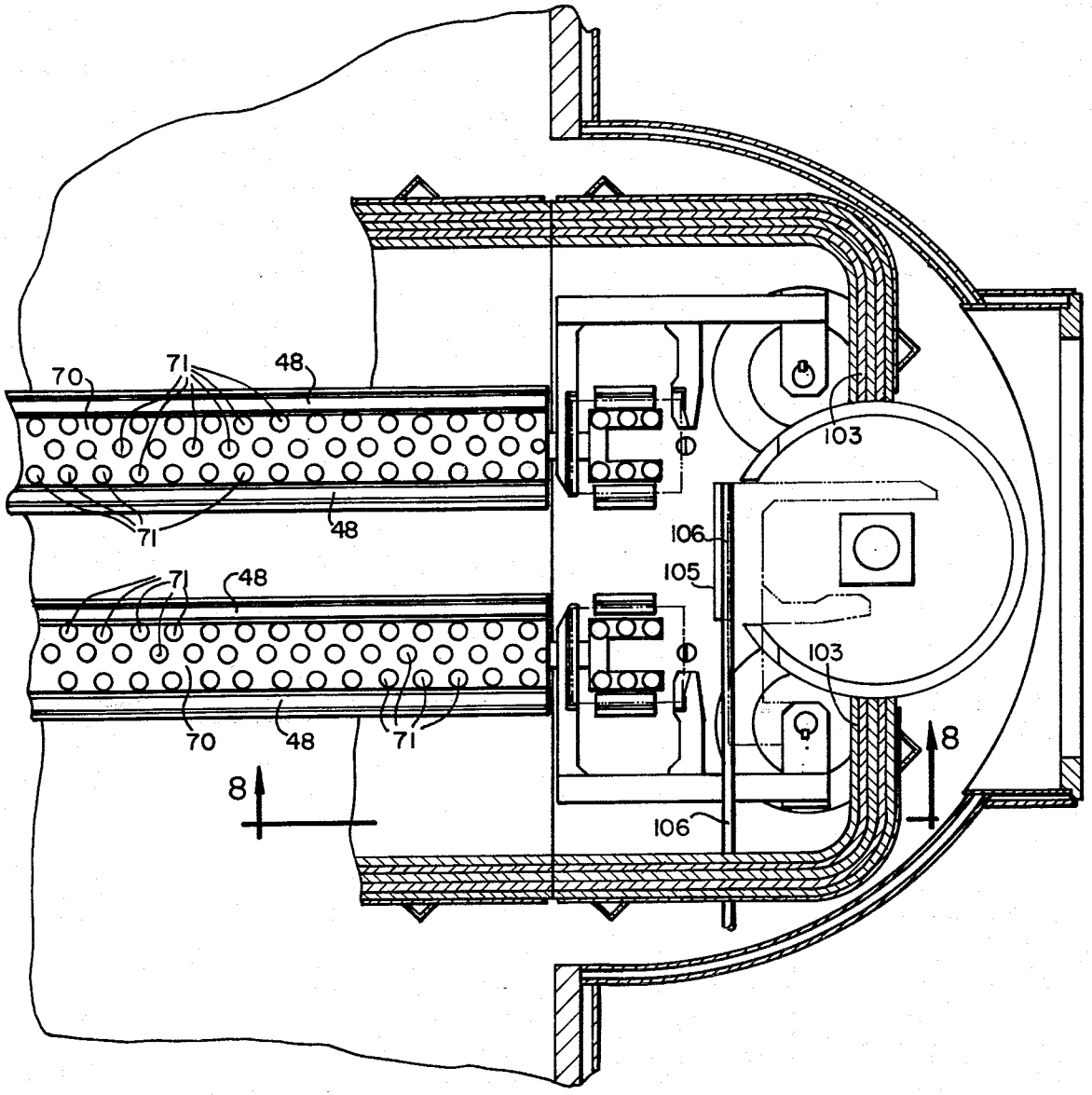
FIG. 9 is a fragmentary horizontal sectional view, enlarged, taken approximately on the line 9—9 of FIG. 1.

Heating elements shown generally at E in FIG. 8 are provided throughout the heated zone.

Within the furnace 15, a plurality of upright posts 28 are provided, extending upwardly from the tank 16 which on one side support longitudinally extending support plates 29 and which on the other side have inverted V-shaped rails 30.

Figure 5:
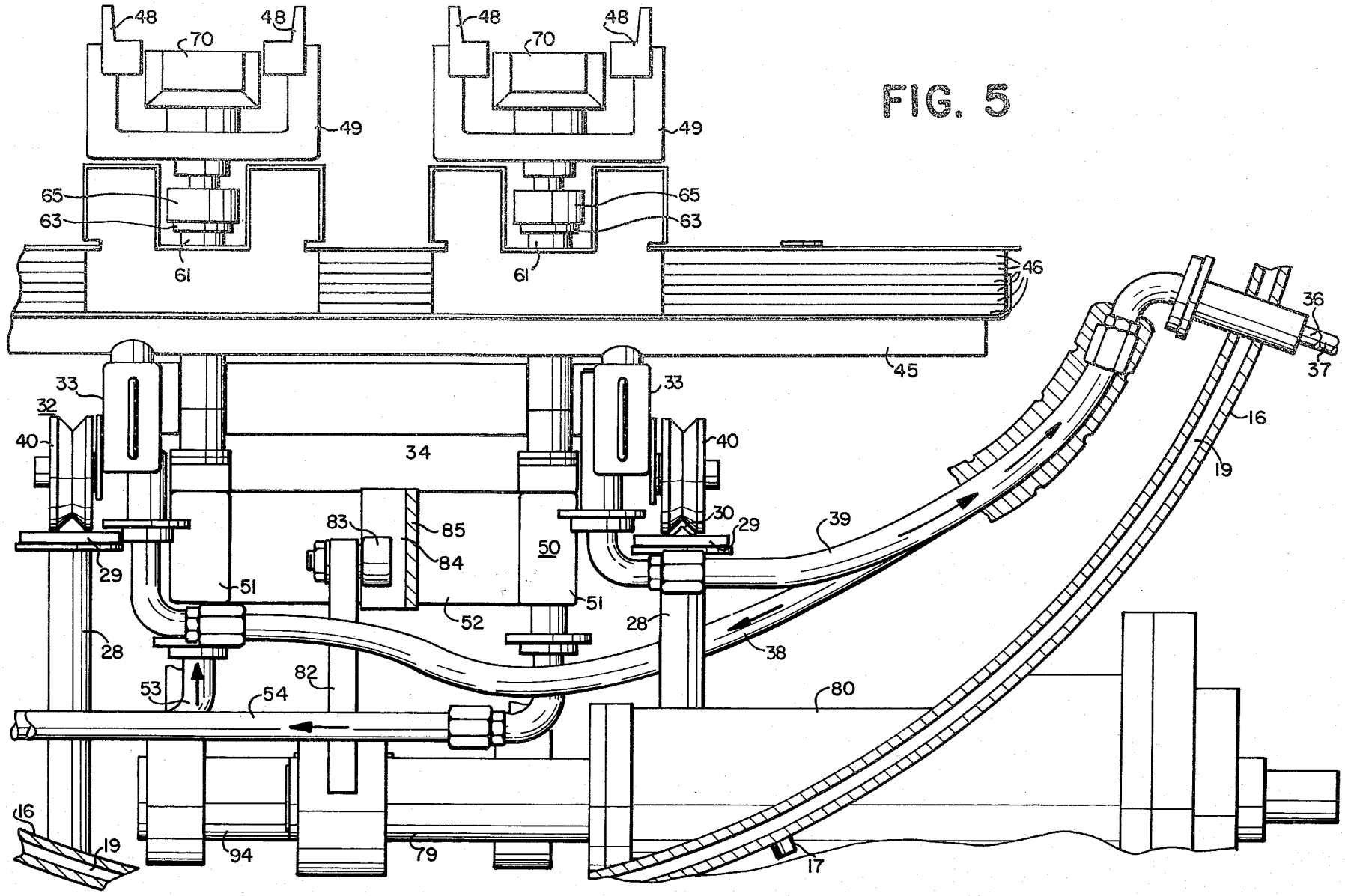
FIG. 5 is a fragmentary vertical sectional view, enlarged, taken approximately on the line 5—5 of FIG. 1.
Figure 6:
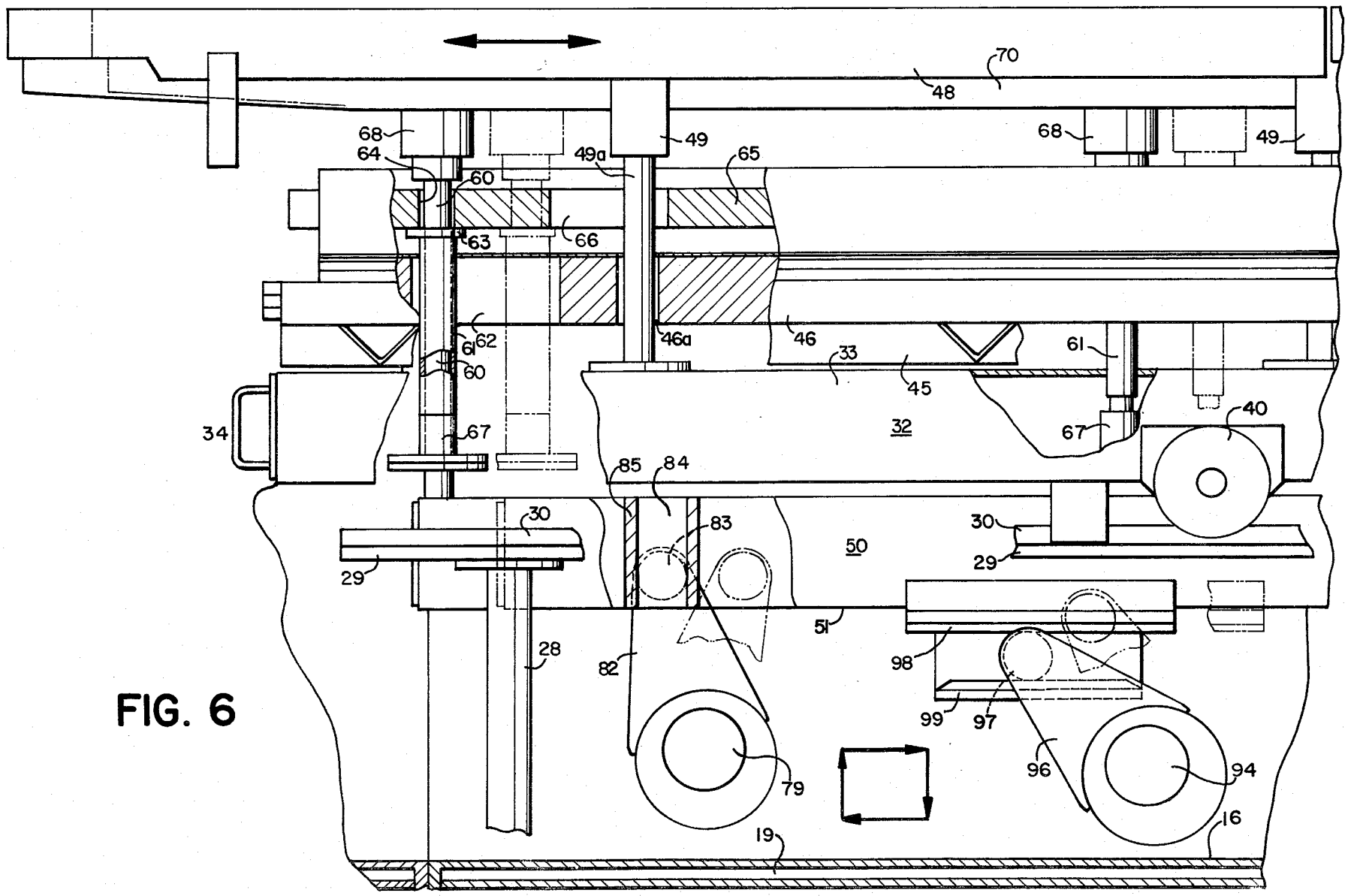
FIG. 6 is a fragmentary longitudinal, sectional view taken approximately on the line 6—6 of FIG. 4 with parts being broken away to show details of construction.
Figure 7:
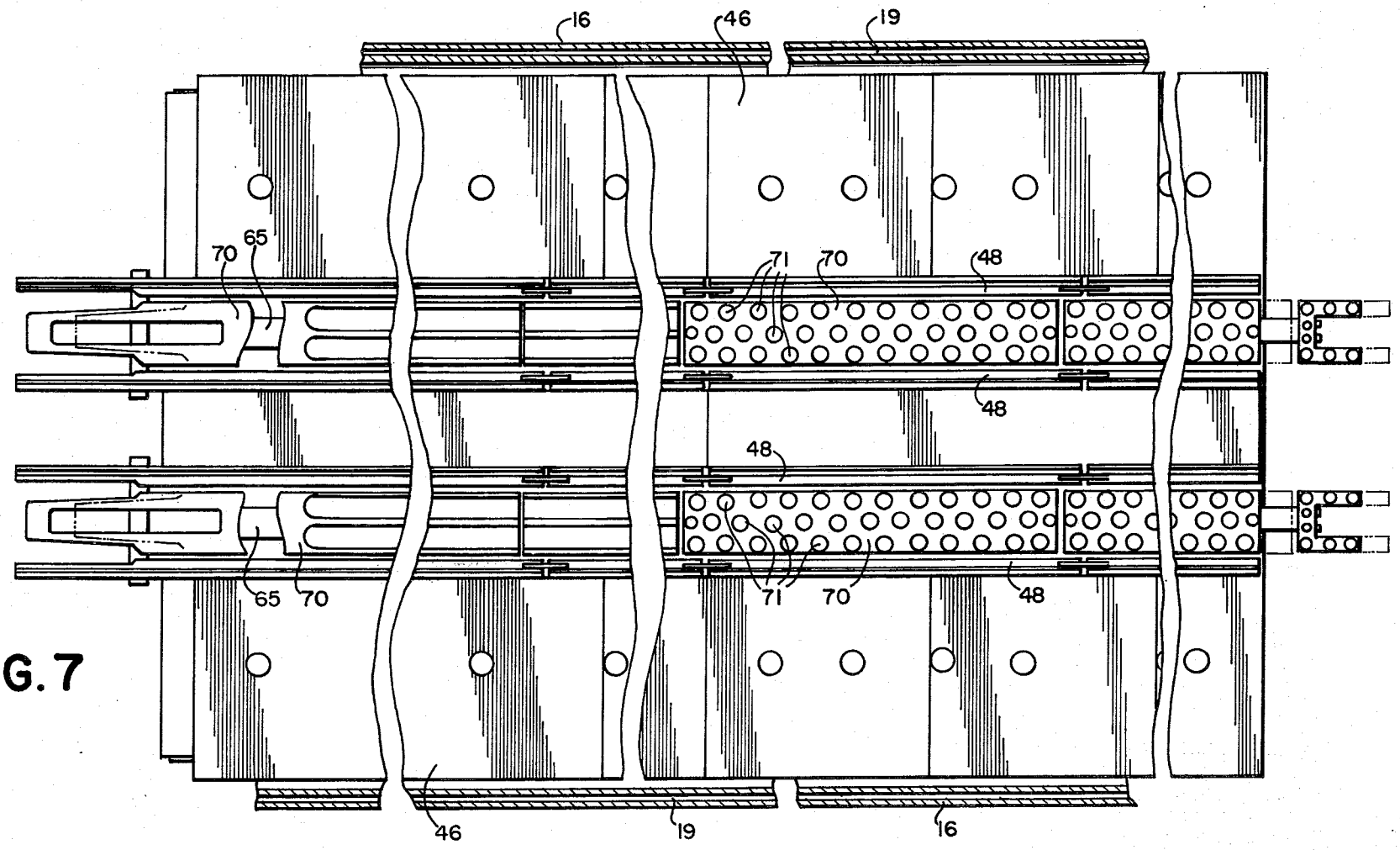
FIG. 7 is a fragmentary horizontal sectional view taken approximately on the line 7—7 of FIG. 1 but with the furnace wall omitted.

A stationary frame 32, as shown in FIG. 5, is provided having hollow elongated longitudinal box beams 33 with hollow cross beams 34 with their interiors in communication with the interiors of the beams 33 for cooling liquid circulation. Cooling liquid for this purpose is supplied through an inlet connection 36 and discharged through a delivery connection 37, flexible detachable connector hoses 38 and 39 being utilized.

The frame 32 is supported at each end on wheels 40 on the tracks 29 and 30 to permit retraction of the frame 32 for inspection and maintenance if desired.

The frame 32 supports the insulation frame which carries a plurality of layers of furnace insulation 46 with spaced stationary longitudinally extending work piece supports 48 having transverse connectors 49 at spaced intervals therealong. The work piece supports 48 and connectors 49 can be of any suitable material which is resistant to the temperatures encountered in the furnace, and has high temperature stability, graphite and high temperature ceramics being suitable materials.

The connectors 49 are supported on pins 49*a* extending upwardly from the stationary frame 32 through openings 46*a* in the insulation 46.

Between and below the longitudinal side box beams 33, and on each side, movable frame 50 is provided having longitudinal hollow side box beams 51 and hollow cross beams 52 with their interiors in communication with the interiors of the beams 51 for cooling liquid circulation. Cooling liquid for this purpose is supplied through a supply hose 53 and discharged through a return hose 54.

The movable frame 50 has a plurality of supporting pins 60, preferably of graphite, extending upwardly therefrom and with surrounding sleeves 61, preferably also of graphite extending upwardly through elongated slots 62 in the insulation 46. The sleeves 61 have washers 63, preferably also of graphite, at their upper ends with the pins 60 extending thereabove. The pins 60 extend through an opening 64 in a longitudinally reciprocable shield 65 of fibrous graphite insulation. The shield 65 has an elongated slot 66 for movement relative to the support pins 49*a*.

The pins 60, at their lower ends, are carried in steel sockets 67 carried on the frame 50.

The pins 60, at their upper ends extend into sockets 68, preferably of graphite, connected to elongated platforms 70, preferably of graphite or high temperature ceramics, which have on their upper faces a plurality of molybdenum buttons 71 for engagement with the work pieces. The platforms 70 are of such length as to reduce the cumulative effect of thermal expansion.

In order to move the platforms 70 in a path to advance the work along the fixed supports 48, the platforms 70 are moved in a path which is preferably substantially rectangular with an upward movement for elevation of the platforms 70 above the supports 48, a forward movement in an elevated position, a downward movement for retraction of the platforms 70 below the supports 48, and a return movement in a lowered position for repetition of the movements just referred to.

For this purpose, a pressure fluid cylinder 75 is provided, pivotally carried on a bracket 76 on the exterior of the tank 16 with a piston (not shown) operating a piston rod 77 to actuate a rocker arm 78 which is connected to a shaft 79 extending through a seal 80.

The shaft 79 has a rocker arm 82 secured thereto for moving an actuator roller 83 which engages in a vertical slot 84 in brackets 85 secured to beams 52 for horizontal movement of the frame 50 and the platforms 70 carried thereby.

For this purpose, also, a pressure fluid cylinder 88 is provided, pivotally carried on a bracket 89 on the exterior of the tank 16 with a piston (not shown) operating a piston rod 90 pivotally connected to a rocker arm 91. The rocker arm 91 is connected by a rod 92 pivotally connected thereto and to a rocker arm 93. The rocker arms 91 and 93 are connected to shafts 94 extending through seals 95.

Each shaft 94 has a rocker arm 96 secured thereto for moving an actuating roller 97 which engages a horizontal plate 98 on the undersides of the beams 51 for an elevating action and which can engage a lower horizontal plate 99 for positive draw down if required and thereby effect vertical movement of the frame 50 and the platforms 70 carried thereby. The combined action of the rollers 83 and 97 provides the desired cyclic movement of the platforms 70 in the path previously described.

In spaced relation above the supports 48, insulation 100, similar to the insulation 46 may be provided.

The unloading apparatus 24 which receives the work pieces advanced along the supports 48 forms no part of the present invention but to reduce the internal circulation and undesired heat transfer within the tank 16 may include lower insulation 101, aligned with the insulation 46, upper insulation 102, aligned with the insulation 100, and vertical end insulation 103. Within the space enclosed by the insulation 101, 102, 103 a radiation blocking door 105 pivotally carried by a shaft 106 may be provided. The shaft 106 extends through a seal 107 for actuation by an arm 108 having a piston rod 109 connected thereto from a piston (not shown) in a cylinder 110 pivotally mounted on a bracket 111 on the flange 23.

The mode of operation will now be pointed out.

Work pieces introduced by the charging mechanism 21 are supported by the work piece supports 48.

Actuation of the piston rod 90 by application of fluid pressure in the cylinder 88 is effective through the shafts 94, to the rocker arms 96 and the engagement of the actuating rollers 97 on the plates 98 to raise the movable frame 50 and the platform 70 to raise work pieces from the longitudinal supports 48 and while so raised actuation of the piston rod 77 is effective through the rocker arm 78, shaft 79, rocker arm 82 and actuating roller 83 in the slot 84 to move the elevated platform to advance the work pieces to a new location above the supports 48. At the end of the horizontal advance, the platform 70 is lowered by the release of pressure fluid from the cylinder 88 which is effective on the shaft 94, the rocker arm 96 and the actuating roller 97, and the lower plate 99.

When the platform 70 reaches its lower position it is returned to its original position, ready for elevation as desired, by the action of the cylinder 75, through the piston rod 77, rocker arm 78, shaft 79, rocker arm 82 and roller 83 in the slot 84.

When the furnace is in use cooling of the stationary frame 32 and the movable frame 50 is effected as previously pointed out. Overheating of the frames 50 and 32 is prevented in part by the shielding action of the insulation 46 and further prevented by the shielding action of the shield 65 which by its movement cuts off line of sight transmission of radiant heat through slots 62.

The parts of the advancing mechanism above and immediately below the insulation 46 and the shield 65, including the longitudinal work supports 48 and the supporting structure therefor, including the pins 49*a*, and the connectors 49 are of materials which are not affected adversely by the very high temperatures in the furnace.

The platforms 70, and their supporting structure above and immediately below the platforms 70 including the pins 60, the sleeves 61, the washers 63 and the sockets 68 are also of materials which are not adversely affected by the high temperatures in the furnace.

The sleeves 61 may also be easily replaced if desired.

The use of the molybdenum buttons 71 on the top of the platforms 70 and in supporting relation to the work pieces also prevents any interaction between the work pieces and the graphite of the platforms 70.

We claim:

1. Apparatus for the support of work pieces in a vacuum electric furnace which comprises, within the furnace tank:

heating elements within the upper part of said tank to provide a heated zone, fixedly mounted spaced parallel work supporting rails of a material resistant to the temperatures in said heated zone, a stationary frame disposed below said rails, supporting members for said rails extending upwardly from said stationary frame, shielding members interposed between said rails and said stationary frame for preventing radiant heat transmission from said heated zone to said stationary frame, means for cooling said stationary frame, means for advancing work pieces along said rails, said last means comprising work piece supports movable to positions above and below said rails and longitudinally with respect thereto for elevating work pieces above said rails for advancing movement with respect to said rails, and a second frame movable with respect to said stationary frame for positioning said work piece supports and having supporting pins for said work piece supports extending upwardly therefrom, said shielding members preventing radiant heat transfer to said movable frame, said shielding members include a fixed shield through which supporting members extend, and a movable shield having openings therethrough for said supporting members, said fixed shield being in shielding relation to said openings, and means for cooling said movable frame.

2. Apparatus as defined in claim 1 in which said shielding members include a fixed shield having openings therethrough for supporting pins interposed between said movable frame and said movable work piece supports, and a movable shield in shielding relation to said openings.

3. Apparatus as defined in claim 1 in which said interposed supporting pins are of a material resistant to the temperature of the heated zone of the furnace.

4. Apparatus as defined in claim 3 in which said interposed supporting pins have sleeves in surrounding relation thereto, said sleeves have washers supported thereby, and one of said shielding members is supported by one of said washers.

5. Apparatus as defined in claim 1 in which said work supporting rails are of graphite.

6. Apparatus as defined in claim 1 in which said movable work piece supports are of graphite.

7. Apparatus as defined in claim 5 in which said movable work piece supports comprise platforms with inserts on their upper faces for work piece contact.

8. Apparatus as defined in claim 6 in which said inserts are of molybdenum.

9. Apparatus as defined in claim 1 in which said stationary frame is supported on longitudinal supporting rails for retraction along said rails.

10. Apparatus as defined in claim 1 in which one of said shielding members is a fixed shield and another of said shielding members is a movable shield, and said movable shield is of fibrous graphite insulation.

11. Apparatus as defined in claim 10 in which said movable shield is supported for movement with said movable frame.

12. Apparatus as defined in claim 1 in which actuating members are provided for said movable frame for elevating said frame, advancing the elevated frame, lowering the frame, and returning the frame to its initial position.

13. Apparatus as defined in claim 1 in which actuating members are provided for elevating said movable work piece supports above said rails, advancing said elevated supports along the rails, lowering said supports below said rails, and returning said supports to their initial positions below said rails.

* * * * *

UNITED STATES PATENT OFFICE

CERTIFICATE OF CORRECTION

Patent No. 4,212,633 Dated July 15, 1980

Inventor(s) Benjamin A. Kreider and William J. Metalsky

It is certified that error appears in the above-identified patent and that said Letters Patent are hereby corrected as shown below:

Column 6,

Line 4, after "for" insert - said - .

Signed and Sealed this

Seventh Day of October 1980

[SEAL]

Attest:

SIDNEY A. DIAMOND

Attesting Officer

Commissioner of Patents and Trademarks